US007280886B2

(12) United States Patent
Iida et al.

(10) Patent No.: US 7,280,886 B2
(45) Date of Patent: Oct. 9, 2007

(54) SEWING MACHINE CAPABLE OF EMBROIDERING

(75) Inventors: Yuji Iida, Chita (JP); Mitsuyasu Kyuno, Ama-gun (JP); Yoshiyuki Uyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/194,625

(22) Filed: Aug. 2, 2005

(65) Prior Publication Data

US 2006/0027152 A1 Feb. 9, 2006

(30) Foreign Application Priority Data

Aug. 3, 2004 (JP) ..... 2004-226587

(51) Int. Cl.
*D05C 5/02* (2006.01)

(52) U.S. Cl. ..... 700/138; 700/136

(58) Field of Classification Search ..... 700/130, 700/136, 138; 112/78, 98, 102, 102.5, 103, 112/470.01, 470.04
See application file for complete search history.

(56) References Cited

U.S. PATENT DOCUMENTS 4,370,940 A * 2/1983 Melzer et al. ..... 112/286
5,850,791 A * 12/1998 Kawaguchi et al. ..... 112/275
5,927,221 A * 7/1999 Porter et al. ..... 112/470.07
7,085,617 B2 * 8/2006 Kaiya et al. ..... 700/138
2005/0223957 A1 * 10/2005 Noguchi et al. ..... 112/225
2006/0005753 A1 * 1/2006 Fujihara ..... 112/286

FOREIGN PATENT DOCUMENTS

JP U 06-052782 7/1994
JP 2003103080 A * 4/2003
JP A 2003-103080 4/2003

* cited by examiner

*Primary Examiner*—Gary L. Welch
*Assistant Examiner*—Nathan E Durham
(74) *Attorney, Agent, or Firm*—Oliff & Berridge, PLC

(57) ABSTRACT

A sewing machine capable of embroidering includes a sewing mechanism having a sewing needle, a frame moving mechanism that moves an embroidery frame based on embroidery data composed of a plurality of embroidery pattern sections, a thread trimming mechanism that executes a thread trim operation based on a thread trim instruction, a thread wiping mechanism that executes a thread wiping operation after the execution of the thread trim operation by the thread trimming mechanism, and a controlling unit that moves the embroidery frame by the frame moving mechanism to a sewing start position of the next embroidery pattern section based on the embroidery data after the thread trim operation by the thread trimming mechanism and before the execution of the thread wiping operation by the thread wiping mechanism.

8 Claims, 18 Drawing Sheets

SEWING MACHINE CAPABLE OF EMBROIDERING

CROSS-REFERENCE TO RELATED APPLICATIONS

This application is based upon and claims the benefit of priority from the prior Japanese Patent Application No. 2004-226587, filed on Aug. 3, 2004 the entire contents of which are incorporated herein by reference.

BACKGROUND

The present disclosure relates to a sewing machine capable of embroidering including a thread trimming mechanism to execute a thread trim operation based on a thread trim instruction and a thread wiping mechanism to execute a thread wiping operation of an upper thread trimmed by the thread trimming mechanism.

Sewing machines capable of embroidering include a cloth presser to press work cloth when carrying out an embroidery sewing process, a cloth presser mechanism to drive the cloth presser, a thread trimming mechanism to trim an upper and lower thread on sewing completion and a thread wiping mechanism to wipe the trimmed upper thread with a wiper member.

For example, JP-A-2003-103080 discloses a multi-headed industrial sewing machine including a thread trimming device provided in the sewing machine bed to automatically trim the upper thread and the lower thread and a thread wiping device provided on a head of the sewing machine which, after thread trimming by the thread trimming device, pulls out an upper thread end connected to an eye of a sewing needle by lifting the upper thread above the needle plate.

The aforementioned thread wiping device includes a wiper having a hook on the end, a wiper drive mechanism to drive the wiper to wipe the thread and an upper thread retainer to retain the upper thread end of the wiped thread after sewing is completed. When a thread trim operation is executed by a thread trimming device when a needle bar and a cloth presser is in a lifted position, the wiper, after being projected to the projecting position, is immediately returned to the original retracted position. Consequently, the trimmed upper thread is hooked by the hook of the wiper, pulled out of the work cloth and retained by the upper thread retainer provided above the needle plate.

Since an industrial sewing machine has plenty space between the bed and the head, a relatively large thread wiping device can be provided on the wiper device allowing for a provision of an upper thread retainer. However, in a household sewing machine, the machine itself is small, hence only a small space is available between the bed and the head, which requires a size reduction of the wiper device and an omission of the upper thread retainer.

However, the omission of the upper thread retainer gives rise to cases, in which the trimmed and wiped upper thread hangs from the wiper down to the cloth presser. If the work cloth is moved to the next sewing position in such state, in cases the direction of movement of the work cloth is the same as the thread wiping direction and the like, the upper thread end could slip in under the cloth presser depending on the direction of movement. As a result, the upper thread end could be pressed by the cloth presser, lowered to start the sewing process and sewn into subsequent sewing sequence.

On the other hand, the wiper mechanism of the sewing machine disclosed in JP-B-H06-52782 includes a wiper body rotatably supported by a sewing machine frame, a presser foot to press a work piece to be sewn, a vertically moving unit to be vertically moved with the presser foot, and a connecting link having one end contacting the upper end of the vertically moving unit, and the other end connecting to the wiper body. In this wiper mechanism, the wiping of the sewing thread is actuated by lifting the presser of the sewing machine, which in turn lifts the vertically moving unit contacting the presser. Then, the lifting of the vertically moving unit moves the lower end of the wiper body towards the sewing needle via the connection link to wipe up the sewing thread.

However since the wiper body moves in conjunction with the vertical movement of the presser foot, a stroke of the movement of the wiper body cannot be increased. Therefore, in some cases the trimmed upper thread cannot be reliably pulled out from the work cloth. Also, similar to the thread trimming device described in the above separate patent publication, even if the upper thread could be pulled out from the work cloth, there is a possibility that the upper thread end gets pressed down by the presser foot and sewn into subsequent sewing sequence, when the upper thread is hanging from the wiper body to the presser foot at sewing start time, as in the thread wiping device disclosed in the above-noted JP-A-2003-103080.

SUMMARY

The purpose of the disclosure is to provide a sewing machine capable of embroidering capable of reliably pulling out an upper thread from a work cloth by a thread wiping operation and moreover preventing the upper thread from being sewn into subsequent sewing sequence.

The sewing machine capable of embroidering of the disclosure is characterized by including a sewing mechanism having a sewing needle, a frame moving mechanism that moves an embroidery frame based on embroidery data composed of a plurality of embroidery pattern sections, a thread trimming mechanism that executes a thread trim operation based on a thread trim instruction and a thread wiping mechanism that executes a thread wiping operation after the execution of the thread trim operation by the thread trimming mechanism. The sewing machine capable of embroidering of the disclosure is further characterized by a controlling unit that moves the embroidery frame by the frame moving mechanism to the sewing start position of the next embroidery pattern section based on the embroidery data after the thread trim operation by the thread trimming mechanism and before the execution of the thread wiping operation by the thread wiping mechanism.

Because the embroidery frame is moved to the sewing start position of the next embroidery pattern section after the execution of the thread trim operation by the thread trimming mechanism, the upper thread end, which extends from the eye of the sewing needle, penetrates the work cloth via the presser foot. The upper thread end extending further downward from the work cloth is pulled toward the sewing needle and out of the work cloth. The lower thread end which came out of the work cloth is dragged to the opposite direction of the direction of movement of the embroidery frame. Then the upper thread end slipped in between the presser foot and the work cloth is pulled out. Therefore, the upper thread end can be prevented from being sewn into subsequent sewing sequence to the possible extent.

In case the colors of the thread used in the sewing sequence before and after the thread trim are different, the sewing operation needs to be interrupted and the operator is required to exchange the threads. On the other hand if the thread color before and after the thread trim are the same, thread exchange is not required, hence the sewing operation is continued without interruption. Such being the case, a determining unit that determines whether a color of a thread to be used in a sewing process after the execution of thread trim operation is same as a color used in the a thread currently being sewn based on the embroidery data can be provided. If the thread color is determined to be the same by the determining unit, the embroidery frame may be moved by the frame moving mechanism to the sewing start position of the next embroidery pattern section based on the embroidery data after the thread trim operation by the thread trimming mechanism and before the execution of the thread wiping operation by the thread wiping mechanism. If the thread color is determined to be different by the determining unit, the thread wiping operation by the thread wiping mechanism may be performed immediately after the execution of the thread trim operation.

The above configuration reliably prevents the upper thread end from being sewn into subsequent sewing process when continuous sewing operation is performed, while on the other hand, when the sewing operation is interrupted by the thread exchange, the upper thread end can be wiped before the thread exchange.

BRIEF DESCRIPTION OF THE DRAWINGS

Other objects, features and advantages of the present disclosure will become clear upon reviewing the following description of the embodiment example with reference to the accompanying drawings, in which.

DETAILED DESCRIPTION OF EMBODIMENTS

A first embodiment example of the present disclosure in which the present invention is applied to a household electronically controlled sewing machine capable of embroidering is described hereinafter with reference to FIGS. 1 to 16.

Figure 1:
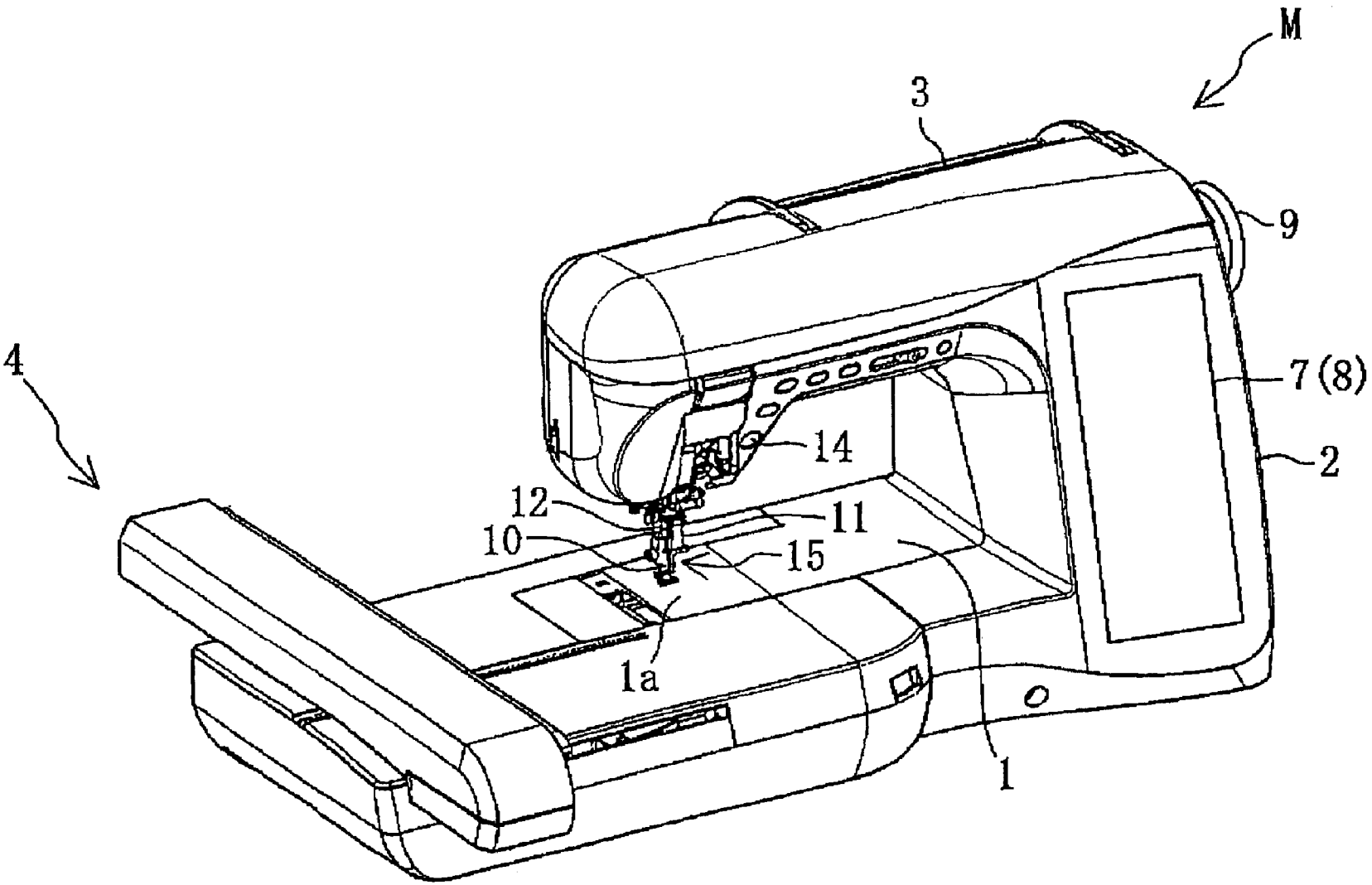
FIG. 1 shows a perspective view of a sewing machine capable of embroidering in accordance with a first embodiment example of the present disclosure.
Figure 2:
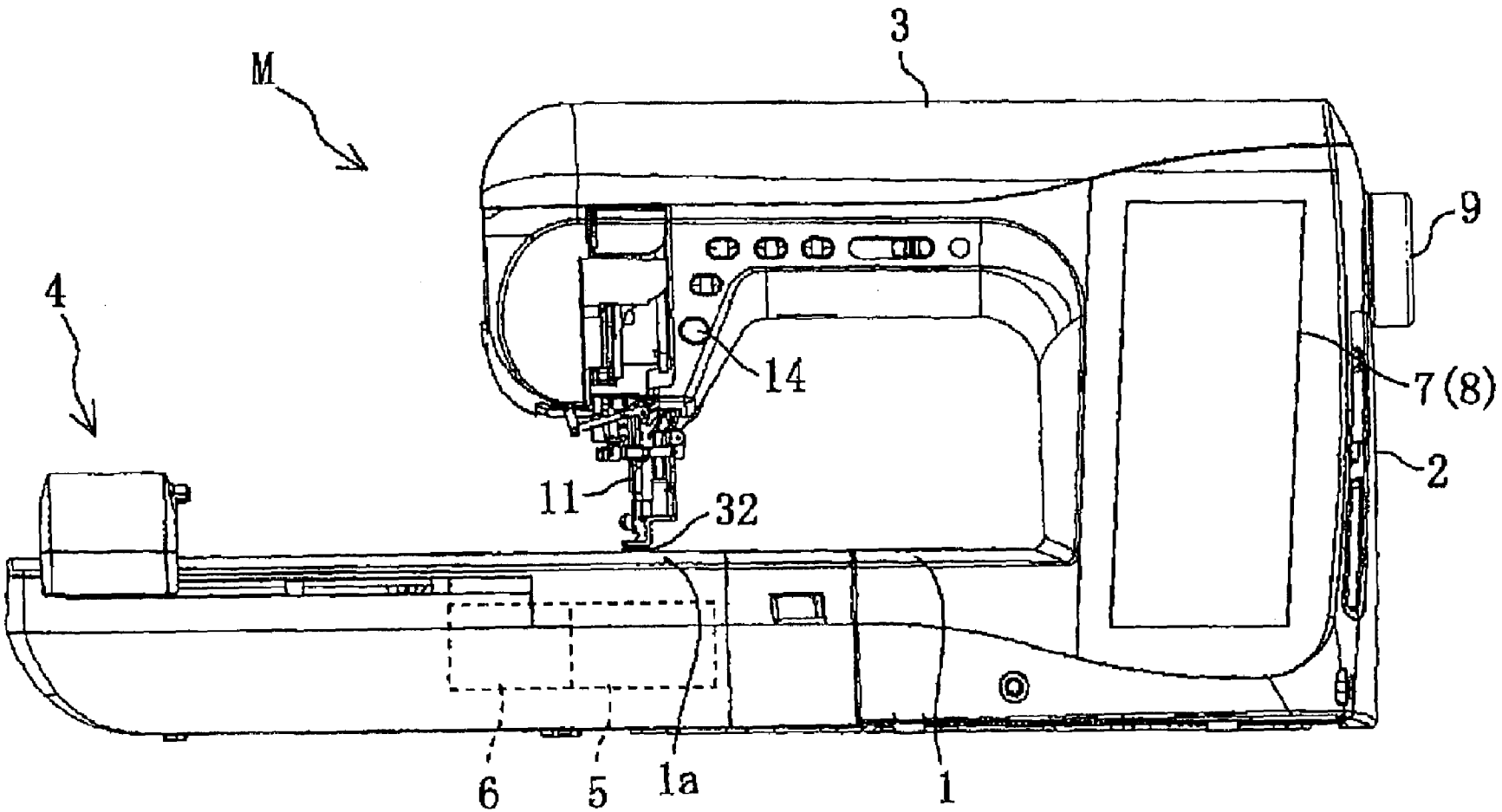
FIG. 2 shows a front view of the sewing machine capable of embroidering.
Figure 3:
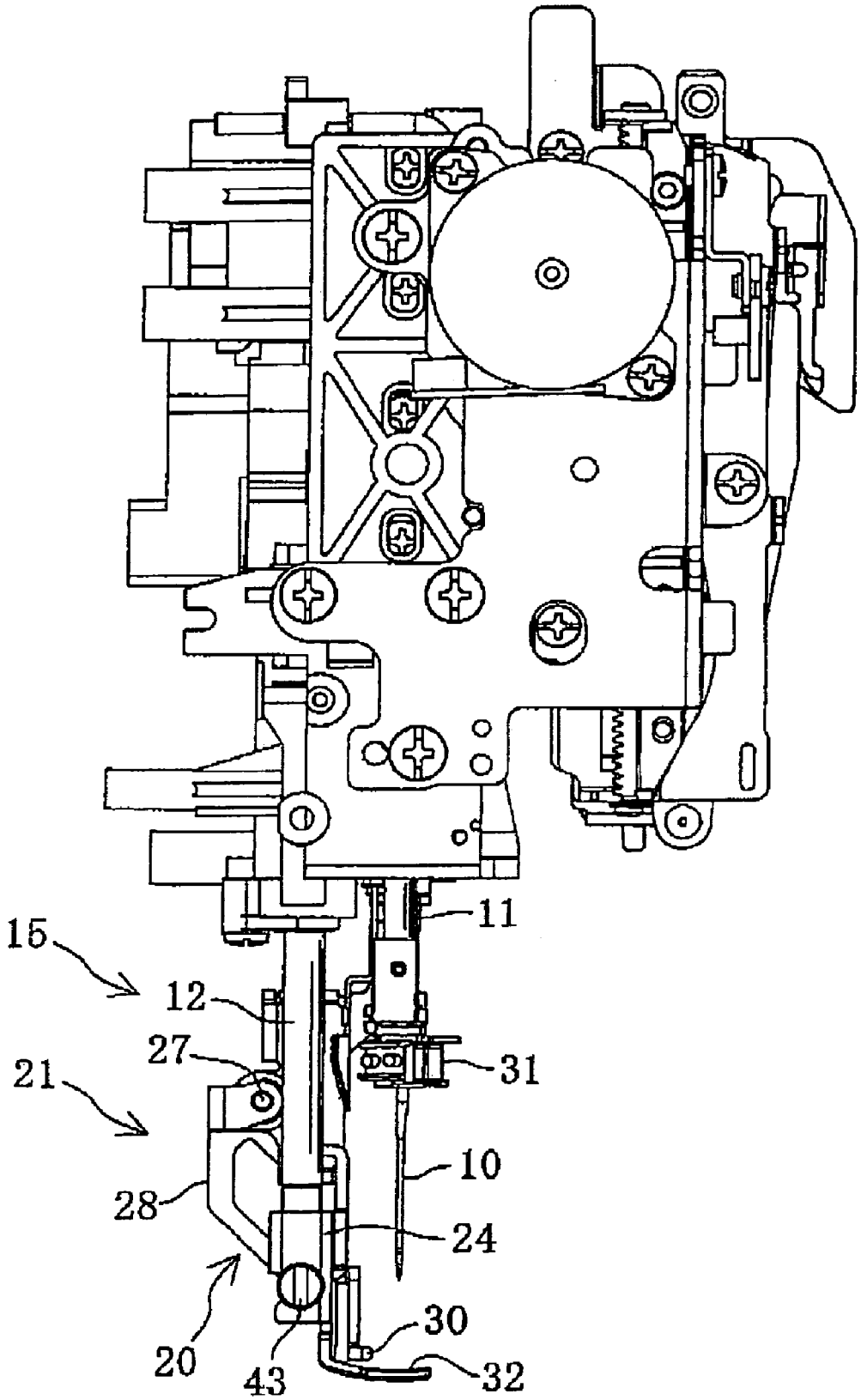
FIG. 3 shows a left side view of a wiper mechanism when a needle bar is swung to the left.
Figure 4:
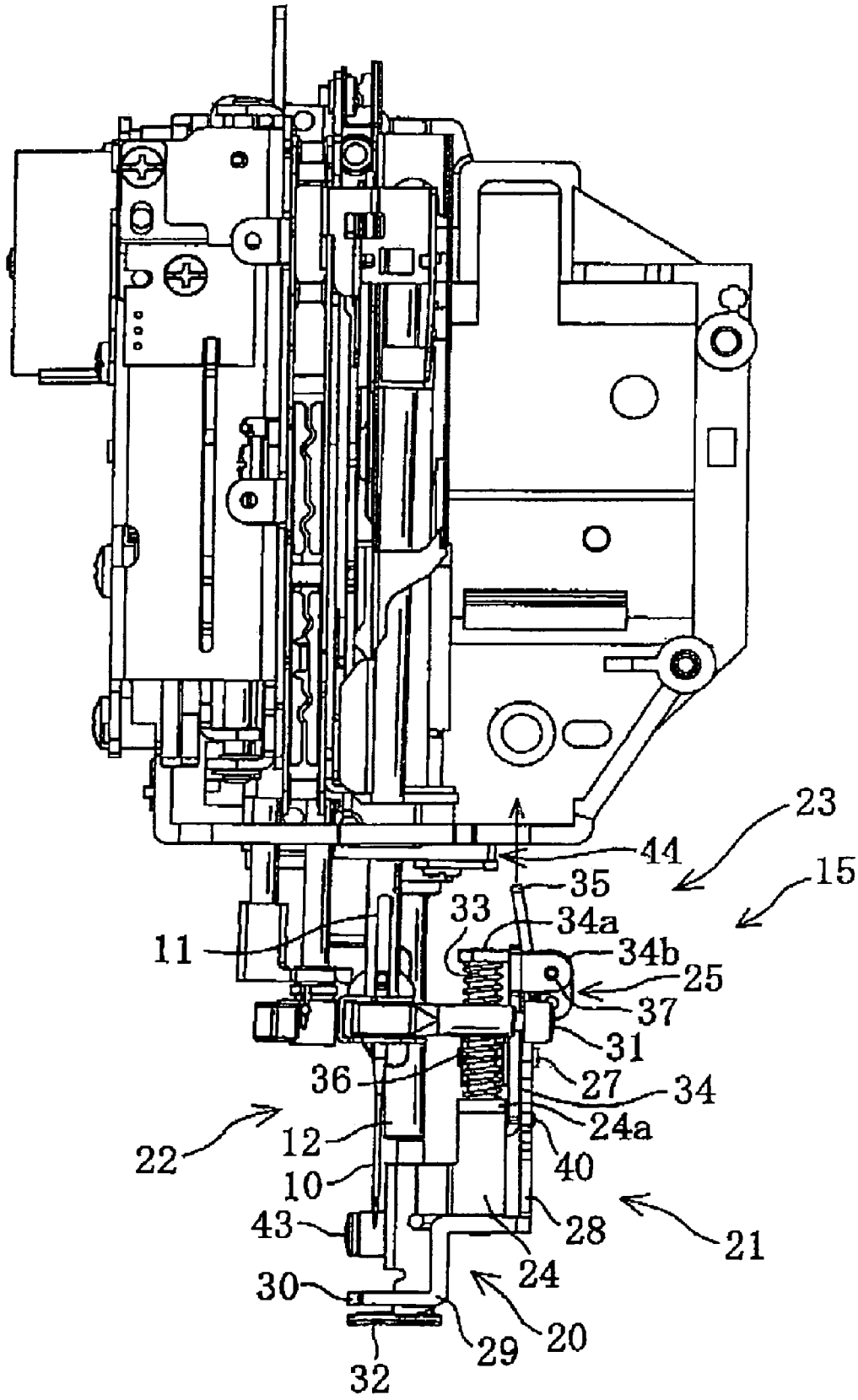
FIG. 4 shows a front view of the wiper mechanism when the needle bar is swung to the left.

As shown in FIGS. 1 and 2, a sewing machine capable of embroidering M according to the first embodiment example is provided with a bed 1, and an arm 3 extending leftward over the bed 1 from the upper end of the pillar 2, which stands upright on the right end of the bed 1. A free arm (not shown) is provided on the left end of the bed 1. The free arm is detachably attached with an embroidery frame drive mechanism 4, which moves the embroidery frame in 2 directions: an X direction (lateral direction) and a Y direction (longitudinal direction), independently in each direction.

Below a needle plate 1*a* of the bed 1, a feed dog vertically moving mechanism (not shown); a feed dog longitudinally moving mechanism (not shown); a shuttle mechanism 5 including a rotating shuttle (not shown) detachably attached with a bobbin wound with a lower thread; and a thread trimming mechanism 6 to trim an upper thread and lower thread. Also, in the front surface of the pillar 2, an elongated liquid crystal display 7 is provided.

On the front side of the liquid crystal display 7, an operation panel 8 (refer FIG. 13) having touch keys composed of transparent poles are provided. The touch keys are mated with pluralities of names for utility patterns (normal sewing patterns formed by moving a cloth in a longitudinal direction by the feed dog and vertically moving as well as laterally swinging the needle bar 11), embroidery patterns, function names to execute each function and displays for numerical setting of various parameters (feed amount and needle swing amount etc.) and the like.

In the arm 3, a laterally extending sewing machine main shaft (not shown) rotationally driven by a sewing machine motor 68 (refer to FIG. 15); a hand pulley 9 capable of rotating the sewing machine main shaft with manual operation; a needle bar drive mechanism (not shown) to vertically move a needle bar 11 and a needle swinging mechanism (not shown) to swing the needle bar 11 in a lateral direction perpendicular to the cloth feeding direction are provided. The needle bar 11 is supported vertically moveably by a needle bar support 44 (refer to FIG. 6) and the needle swinging mechanism laterally swings the needle bar 11 via the needle bar support 44.

In a lower end of the needle bar 11, a sewing needle 10 is detachably attached via a needle clamp member 31 (refer to FIGS. 3 to 6). The sewing machine main shaft is rotationally driven by a sewing machine motor 94 (refer to FIG. 13). Also, in the arm 3, a thread take-up drive mechanism (not shown) to vertically move a thread take-up in synchronization with the vertical movement of the needle bar 11; an automatic thread tension mechanism (not shown) to automatically set a thread tension to be operated on the upper thread by a thread tension motor 95 (refer to FIG. 13); a vertically moving mechanism 13 (not shown) to liftably drive the presser bar 12 which is vertically moveably supported to The sewing machine frame between a lifted position and a lowered position; and an automatic threading mechanism (not shown) etc., are provided.

In the front side of the arm 3, a sewing start/stop switch 14 to instruct the start and stop of a sewing process is provided along with other switches. On the head of the arm 3, a thread wiping mechanism 15 is provided to wipe the thread so as to pull out the upper thread extending from an eye of a sewing needle 10 to the upper surface of a work cloth after trimming the upper thread by a thread trimming mechanism 6.

As shown in FIGS. 3 to 8, the thread wiping mechanism 15 is provided with a wiper mechanism 21 including a wiper member 20 to wipe the thread, a wiper driving unit 22 to actuate the thread wiping movement of the wiper member 20 by driving the wiper mechanism 21 and a switching unit 23 to switch the wiper member 20 between an operable state and an inoperable state in conjunction with the position of the needle bar 11.

The wiper mechanism 21 includes, besides the wiper member 20, a support member 24, a support shaft 33, a drive power input member 25 and a link mechanism 26.

On the lower end of the presser bar 12, a presser foot 32 having a needle insertion 32*a* (FIG. 6) is mounted via a clamp screw 43 and the support member 24 is formed integrally with the presser foot 32. The support member 24 has a vertically paired support 24*a* on which the vertically extending support shaft 33 is fixed. The drive power input member 25 includes a main body member 34 vertically movably supported by the support shaft 33 and a contacting portion 35 provided on the upper end of the body member 34.

The wiper member 20 is supported by a horizontal pivotal shaft 27 swingably and unmoveably, with respect to an axial direction of the horizontal pivotal shaft 27. The horizontal pivotal shaft 27 extends in a needle swinging direction (lateral direction) and is fixably attached to the main body member 34. The wiper member 20 is provided with a circumventing arm 28 and a thread wiper 29 integrally formed with the lower end of the circumventing arm 28.

The thread wiper 29 is formed in a crank when viewed from the front. On the end point of the thread wiper 29, a regulator 30 is provided to keep the wiped upper thread from slipping off. The circumventing arm 28 is in a curved form so as not to interfere with a needle clamp member 31 when the wiper member swings upward to wipe the thread.

A vertical pair of guided portions 34*a* is formed respectively on the upper and lower portion of the main body member 34. The lower guided portion 34*a* is outer-fitted in a vertically slide-able manner in the portion in between a paired supports 24*a* of the support shaft 33. On the other hand, the upper guided portion 34*a* is outer-fitted in a vertically slidable manner in the portion above the upper support 24*a*. Thus the main body member 34 is vertically slidably supported by the support shaft 33.

A compressed coil spring 36 is inserted in the portion in between the supports 24*a* and the upper guided portion 34*a*. The drive power input member 25 is biased upward by the compressed coil spring 36.

On the upper end of the main body member 34, longitudinally paired support pieces 34*b* are formed. The paired support pieces 34*b* protrude to the right from the main body member 34 and a horizontal support shaft 37 is fixed in between the paired support pieces 34*b*. The contacting portion 35 is swing-ably but axially unmoved-ably supported by the horizontal support shaft 37. Also, the contacting portion 35 is biased counter-clockwise when viewed from the front by the elasticity of a twisted coil spring 38, inserted through the horizontal support shaft 37. The contacting portion 35 therefore is locked to the main body member 34. The contacting portion 35 can swing approximately 30° clockwise from the locked position to the main body member 34.

Figure 5:
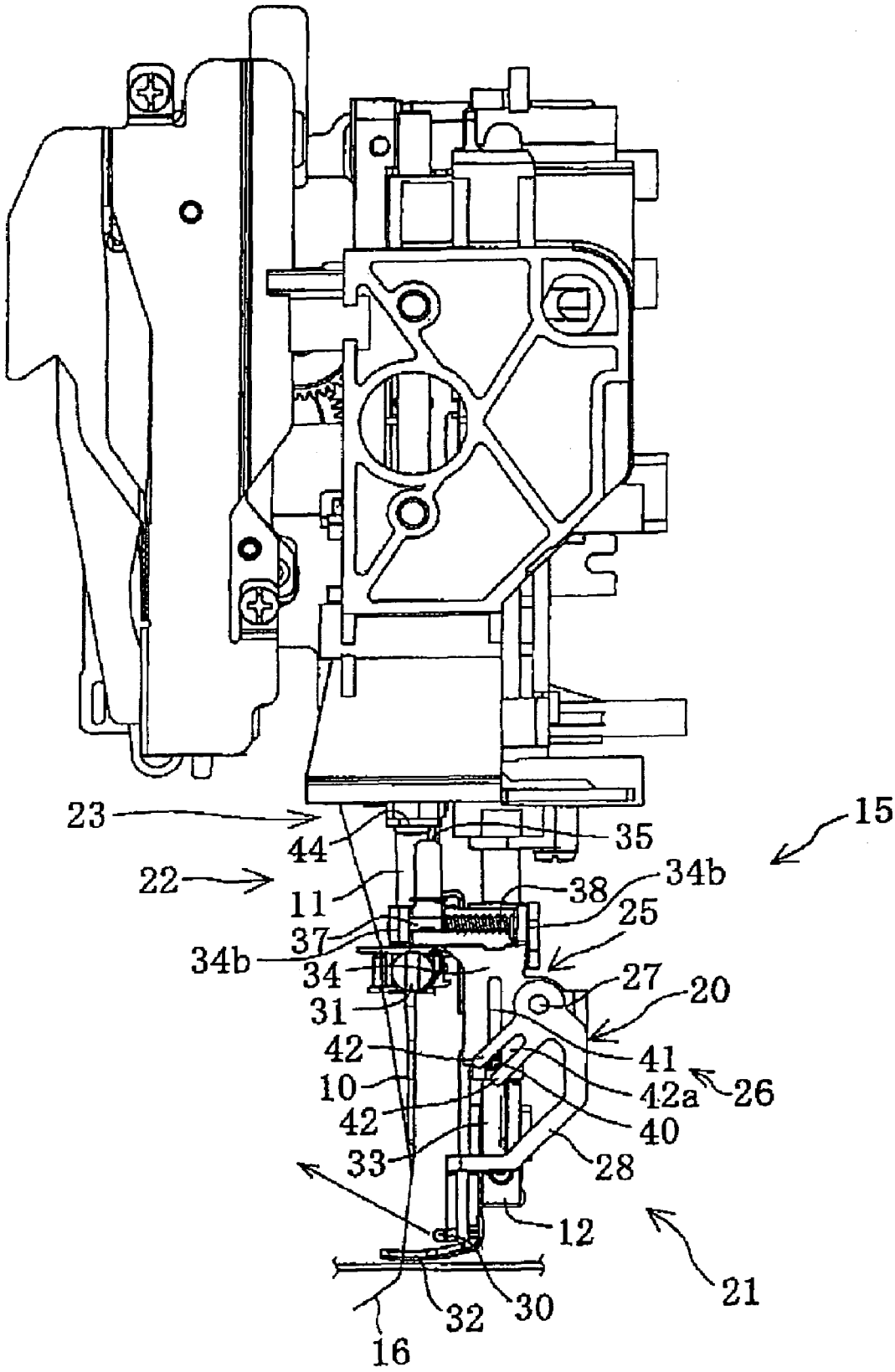
FIG. 5 shows a right side view of the wiper mechanism when a wiper member is swung to the right.
Figure 6:
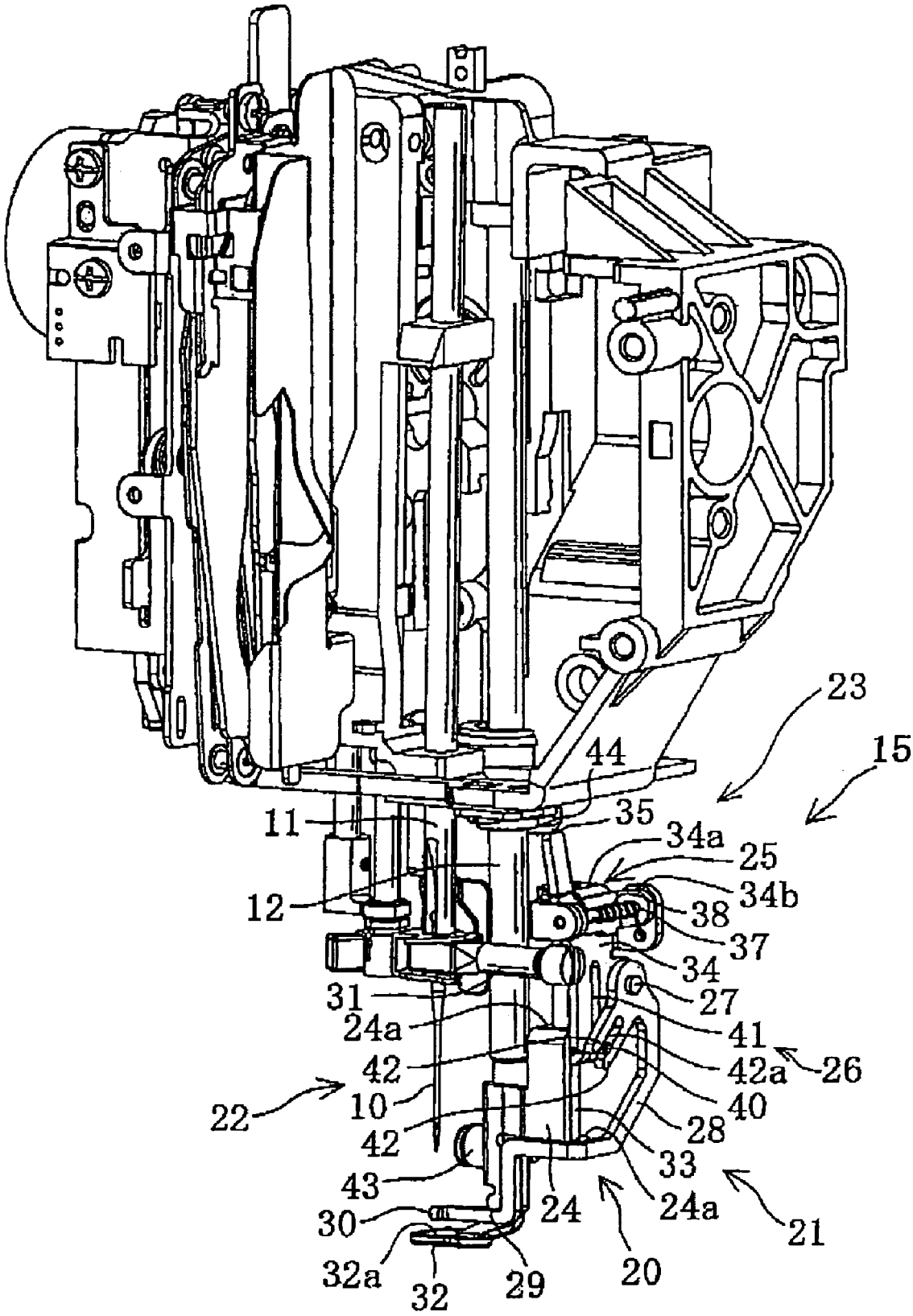
FIG. 6 shows a perspective view of the wiper mechanism when the wiper member is in an inoperable state.
Figure 7:
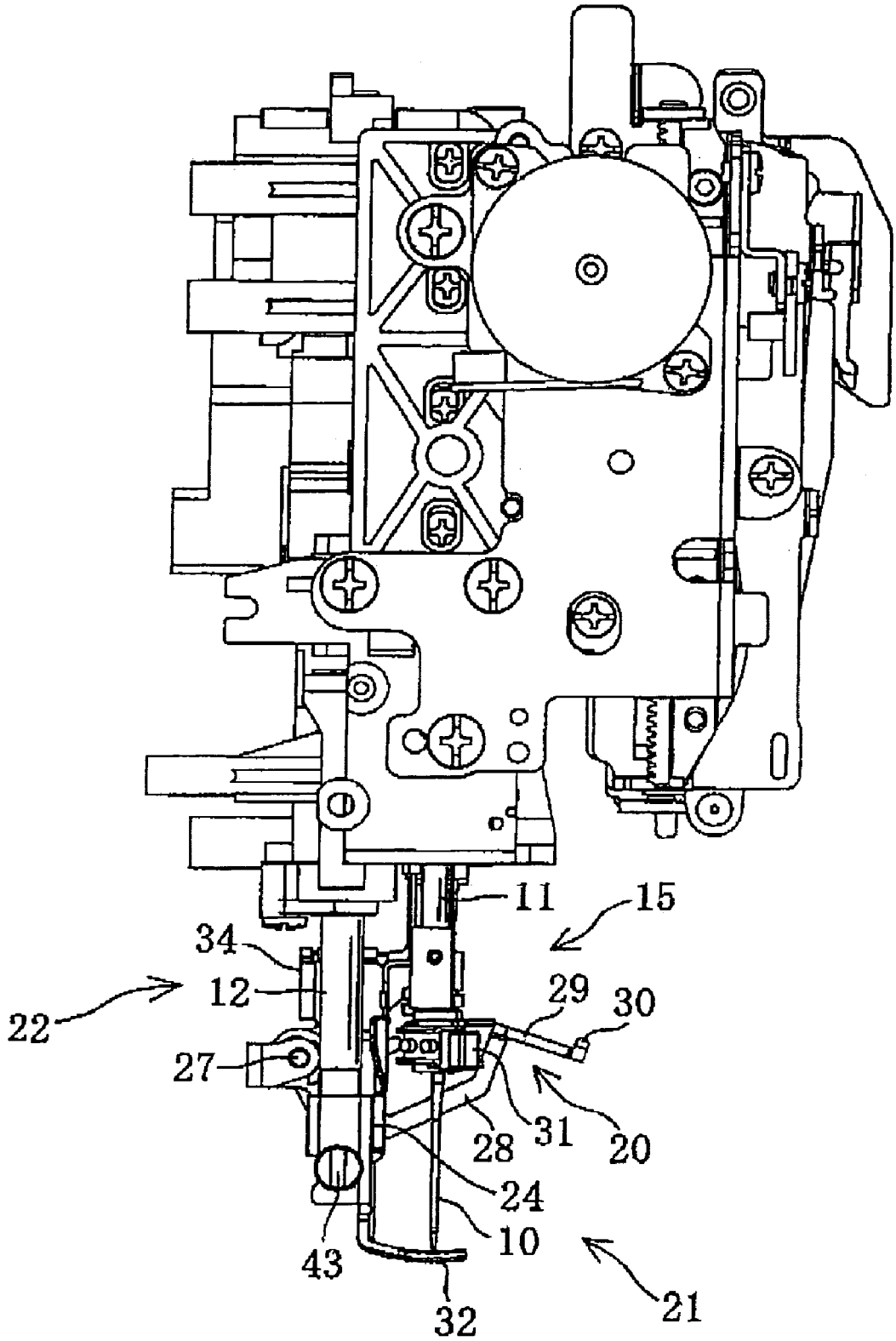
FIG. 7 shows a left side view of the wiper mechanism when the needle bar is swung to the right.
Figure 8:
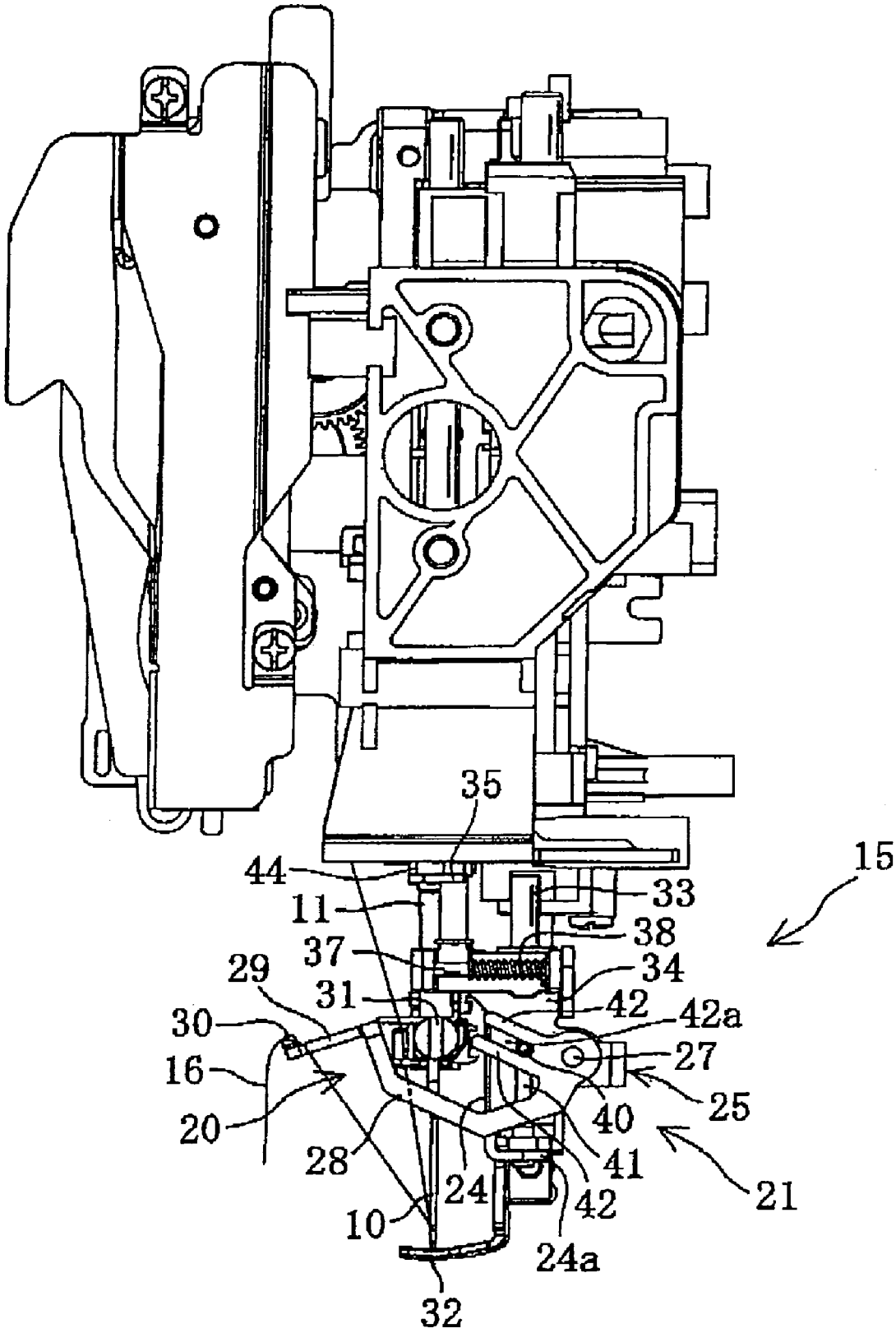
FIG. 8 shows a right side view of the wiper mechanism when the needle bar is swung to the right.
Figure 9:
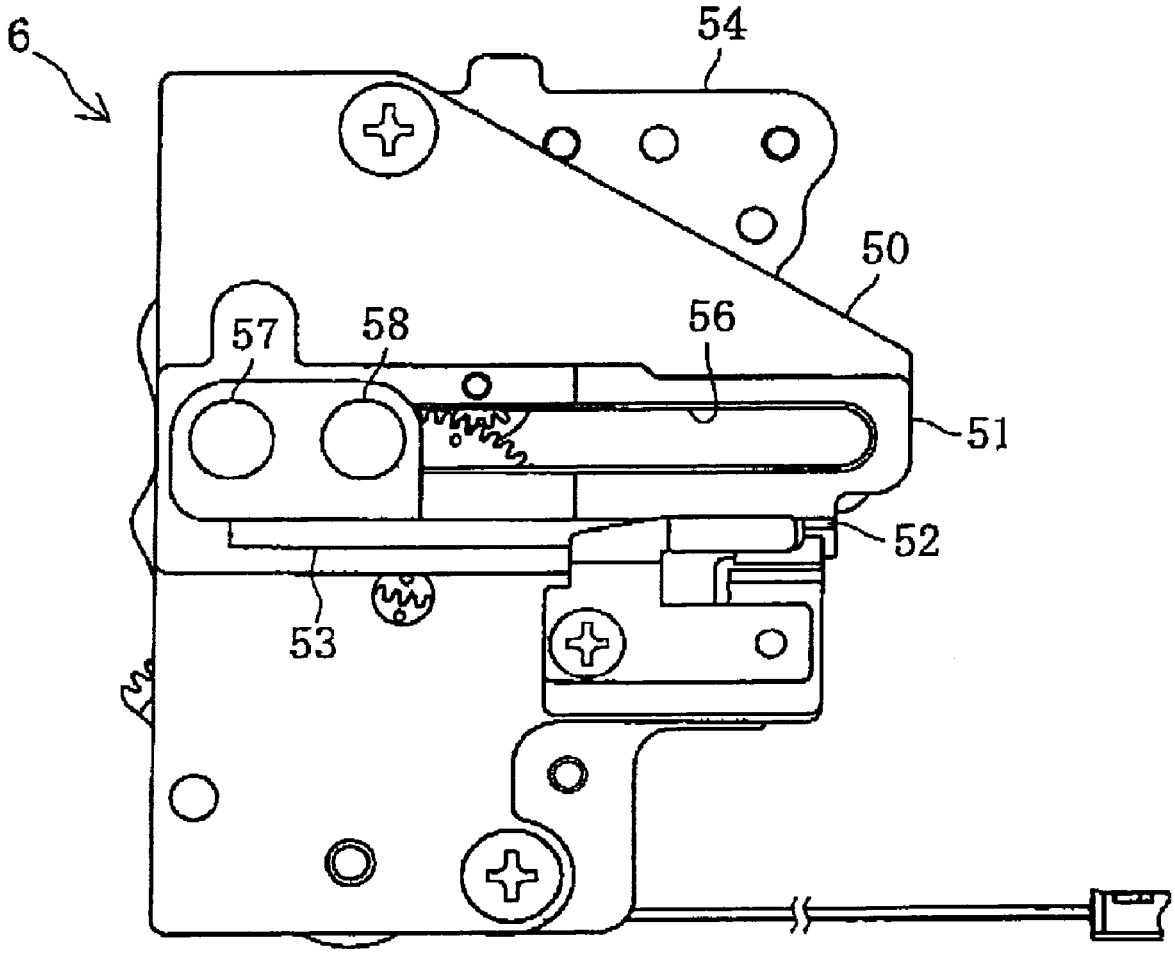
FIG. 9 shows a schematic plan view of a thread trimming mechanism.

The link mechanism 26 is configured as follows. That is, as shown in FIGS. 5, 6 and 8, in the approximate vertical center of the support shaft 33, a drive pin 40 is inserted therethrough in parallel to the thread swinging direction (lateral direction). A vertically elongated slit 41 is formed on the main body member 34. On the end of the wiper member 20, a pair of link arms 42 is provided integrally having a link 42*a* therebetween and the drive pin 40 is engaged slidably both on the slit 41 and the link 42*a*. Thus, the link mechanism 26 is configured by the foregoing drive pin 40, slit 41 and link 42*a*.

When the main body member 34 is moved downward without moving the vertical position of the support member 24, the position of the horizontal pivotal shaft 27 fixed on the main body member 34 is moved downward in relative to the drive pin 40. Consequently, the wiper member 20 in a disposition such that the link 42*a* declines from the rear to the front as shown in FIG. 5, is changed to a disposition to incline from the rear to the front as shown in FIG. 8. As a result, the thread wiper 29 of the wiper member 20 is moved from the rear of the upper thread, which extends from the eye of the sewing needle 10 to the work cloth via the needle insertion 32*a* of the presser foot 32, up to the front of the needle clamp member 31.

Next, the wiper driving unit 22 is described. The wiper driving unit 22 is configured by a vertically moving mechanism to vertically drive the presser bar 12 and drives the wiper member 20 in conjunction with the vertical movement of the presser bar 12.

Figure 12:
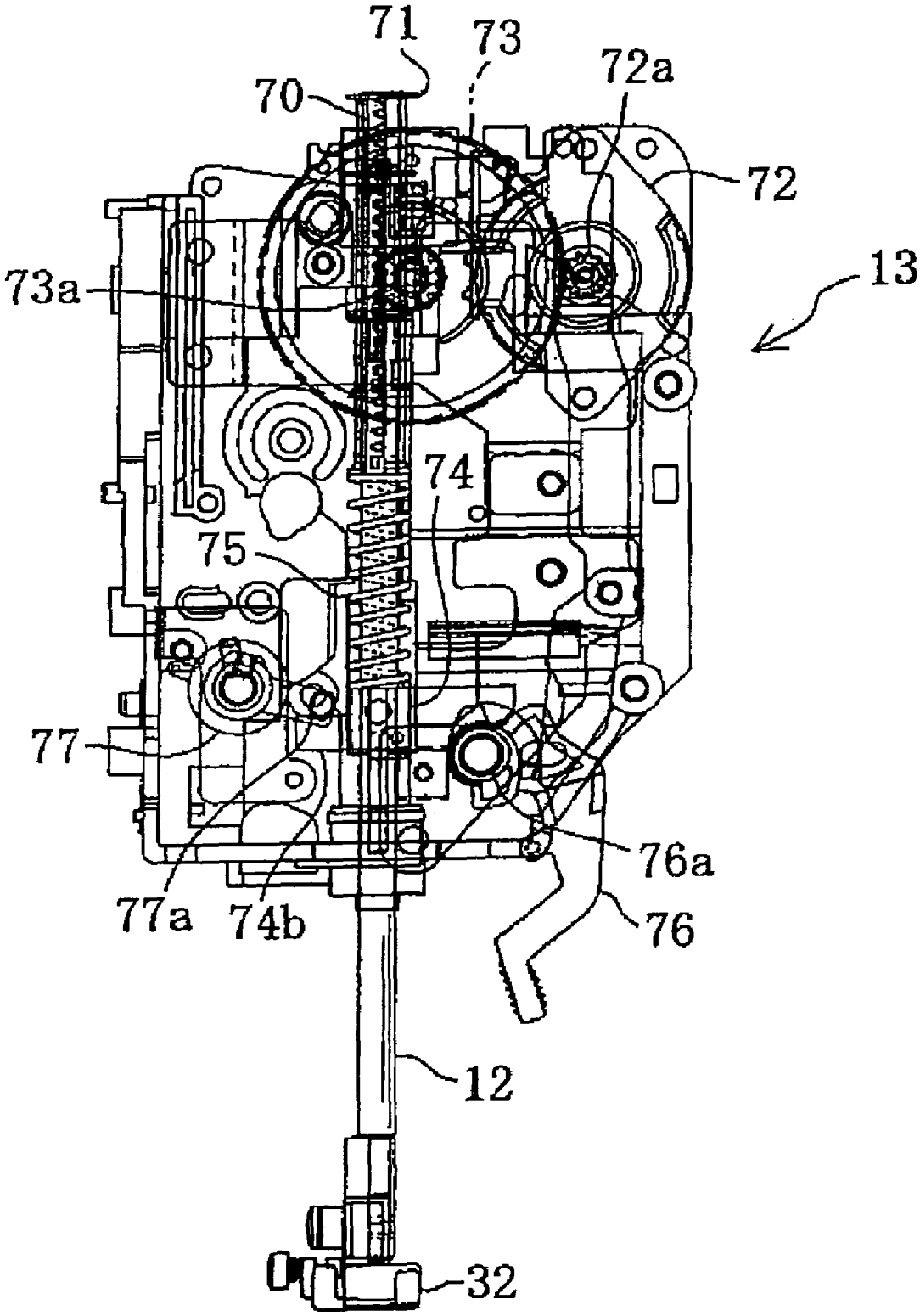
FIG. 12 is a transparent front view of a vertically moving mechanism.

As shown in FIG. 12, the vertically moving mechanism 13 is provided with a rack forming member 70 mounted moveably to the upper end of the presser bar 12, a retaining ring 71 fixed on the upper end of the presser bar 12 and a presser bar drive motor 72 fixed to the sewing machine frame immediately to the right side of the rack forming member 70. The vertically moving mechanism 13 is further provided with a drive gear 72*a*, an intermediate gear 73 connected to an output shaft of the motor 72, a presser bar bracket 74 fixed in the vertical center of the presser bar 12 and a presser bar spring 75. The intermediate gear 73 integrally possesses a small diameter pinion 73*a*. The pinion 73*a* is fitted to a rack of the rack forming member 70.

In the vicinity of the vertically moving mechanism 13, a presser bar lifting lever 76 to vertically move the presser bar 12 with manual operation is provided. The presser bar lifting lever 76 is rotatably supported by the pivotal pin 76*a*.

Also, a potentiometer 77 is provided immediately to the left of the presser bar 12. A shaft 77*a* extending to the right direction from the rotational axis of the potentiometer 77 contacts a leftward protruding protrusion 74*b*, provided on the presser bar bracket 74, from above. A resistance value of the potentiometer 77 is arranged to change by the rotation of the shaft 77*a* induced in response to the vertical movement of the presser bar 12 and the presser bar bracket 74. The control unit 80 detects the height of the presser foot 32 that is, the thickness of the work cloth based on the comparison of the resistance value of the potentiometer 77 with and without the work cloth under the presser foot 32.

When the presser bar drive motor 72 is driven, the drive power is transmitted to the intermediate gear 73 and the pinion 73*a* and the rack forming member 70 is vertically moved via the elasticity of the presser bar spring 75 to vertically move the presser bar 12. The presser foot 32 is vertically moveable in any height within the range of the upper-limit position and the lower-limit position. During the embroidery sewing operation, the presser foot 32 is retained at a predetermined minute distance (for example 1 mm) above the upper surface of the work cloth.

When the needle bar support 44 is moved to the right swing position by the needle swing mechanism, the contacting portion 35 contacts the noodle bar support 44 from below. At this point, the presser bar 12 is lifted by the vertically moving mechanism 13, lifting the presser foot 32 along with the support member 24 which causes the contacting portion 35 to contact the needle bar support 44. The contacting portion 35 contacting the needle bar support 44 becomes locked to that position thereafter. When the support member 24 along with the presser bar 12 is further lifted, the position of the horizontal pivotal shaft 27 fixed to the main body member 34 in the aforementioned manner is lowered in relative to the drive pin 40.

Consequently, the thread wiper 29 of the wiper member 20 is moved from the rear of the upper thread, which extends from the eye of the sewing needle 10 to the work cloth via the needle insertion 32*a* of the presser foot 32, up to the front of the needle clamp member 31. Thus the trimmed upper thread end 16 is wiped as to be pulled out to the upper surface of the work cloth.

On the other hand, when the needle bar support 44 is moved to the left swing position by the needle swinging mechanism, the contact of the contacting portion 35 to the needle bar support 44 is disabled. Therefore, at this point, even if the support member 24 and the presser foot 32 are lifted along with the presser bar 12, since the contacting portion 35 does not contact the needle bar support 44, the wiper member 20 is not moved.

Next, the thread trimming mechanism 6 is described with reference to FIG. 2 and FIGS. 9 to 11. Since this thread trimming mechanism 6 has a configuration, which is common in the art, wherein the thread is trimmed by reciprocably driving the thread taker 53, only a simple description is given.

The thread trimming mechanism 6 is provided adjacent to the left side of the shuttle mechanism 5. The thread trimming mechanism 6 has a thread trimmer base upper plate 50, a guide member 51, a trimmer blade 52, the thread taker 53, a thread trimmer base lower plate 54 and a thread trimmer drive motor 55 (refer to FIG. 13) etc.

On the thread trimmer base upper plate 50, a penetrated long hole (not shown), which is laterally elongated is formed. Above the portion, where the penetrated long hole is formed, a silicon guide member 51 of an approximate plate form is unmovebably fitted On the guide member 51, a guiding long hole 56, laterally elongated is formed. The guiding long hole 56 is provided to overlap with the penetrated long hole.

In front of the right end of the guiding long hole 56 of the guide member 51, a trimmer blade 52 in an approximate parallelogram plate form is vertically inserted. Also, a laterally extending metal thread taker 53 is arranged on the guide member 51.

Figure 10:
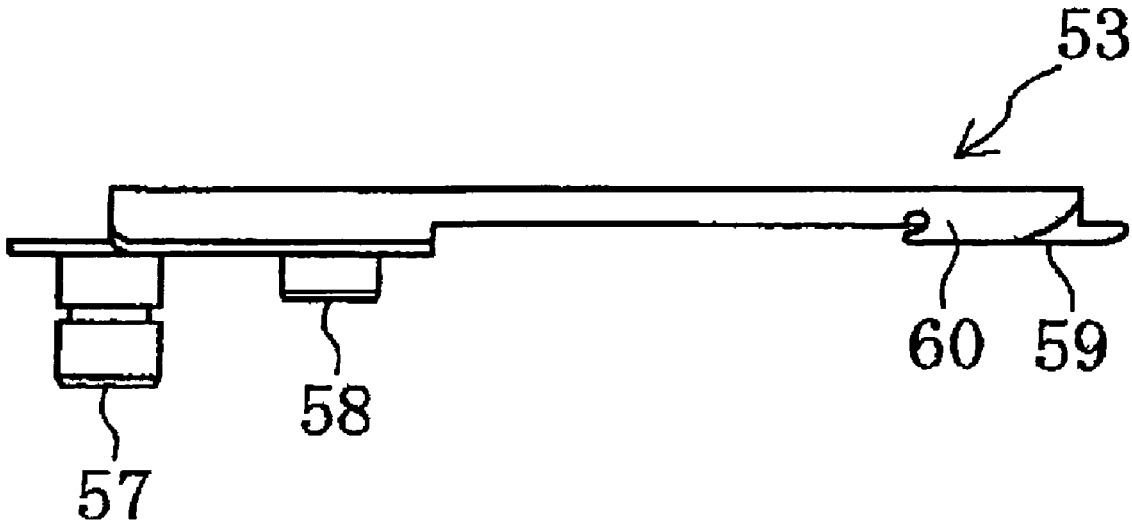
FIG. 10 shows a front view of a thread taker.

As shown in FIG. 10, on the left-rear end of the thread taker 53, 2 downwardly protruding metal guided portions 57 and 58 in cylindrical form are arranged.

These guided portions 57 and 58 each having a diameter slightly smaller than the longitudinal width of the guiding long hole 56 are inserted into the guiding long hole 56 slidably contacting the inner perimeter thereof. This enables the thread taker 53 to be supported slidably in the lateral direction by the guide member 51.

Figure 11:
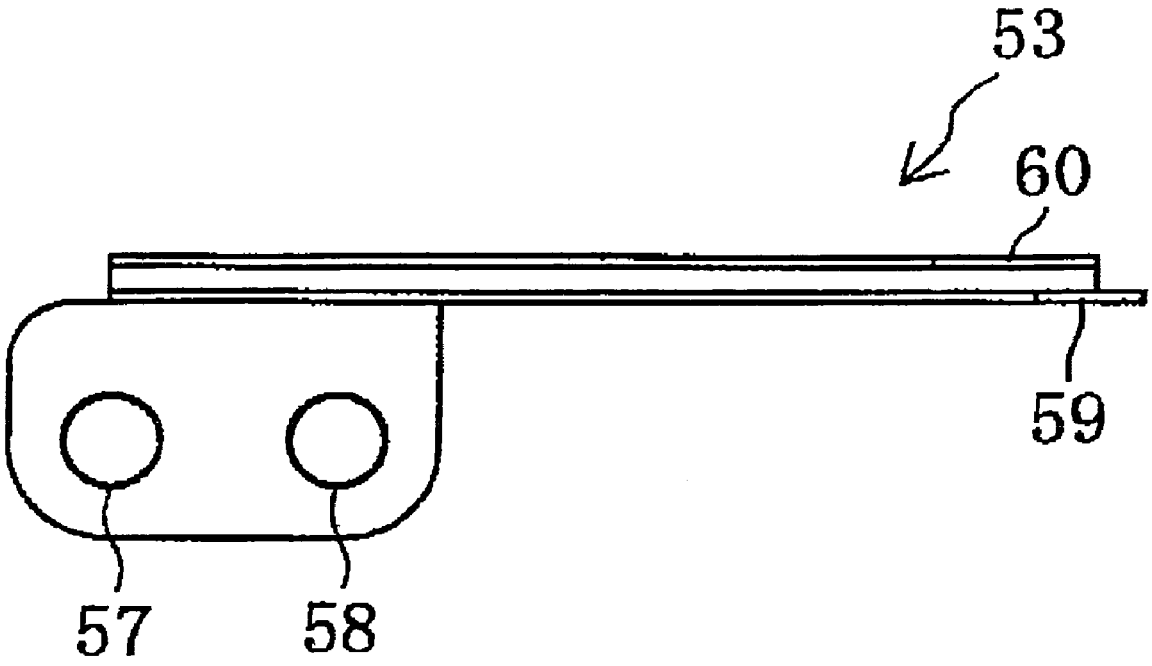
FIG. 11 shows a bottom view of the thread taker.

As shown in FIGS. 10 and 11, the thread taker 53 has a first thread taker 59 and a second thread taker 60 in an approximate hook. The first thread taker 59 is provided on the right and to the rear of the second thread taker 60. Furthermore, the first thread taker 59 and the second thread taker 60 are formed in a vertical disposition and arranged in parallel to one another.

Below the thread trimmer lower plate 54, a thread trimmer drive motor 55 is provided. The thread taker 53 is driven in the lateral direction by the thread trimmer drive motor 55 via a gear mechanism and cam mechanism (not shown).

When the thread trimmer drive motor 55 is driven and the thread taker 53 is laterally reciprocably driven when the sewing machine main shaft is in a predetermined phase angle (for example approximately 38°), the thread caught by the first and second thread taker 59 and 60 are moved to intersect with the trimmer blade 52 and trimmed.

Figure 13:
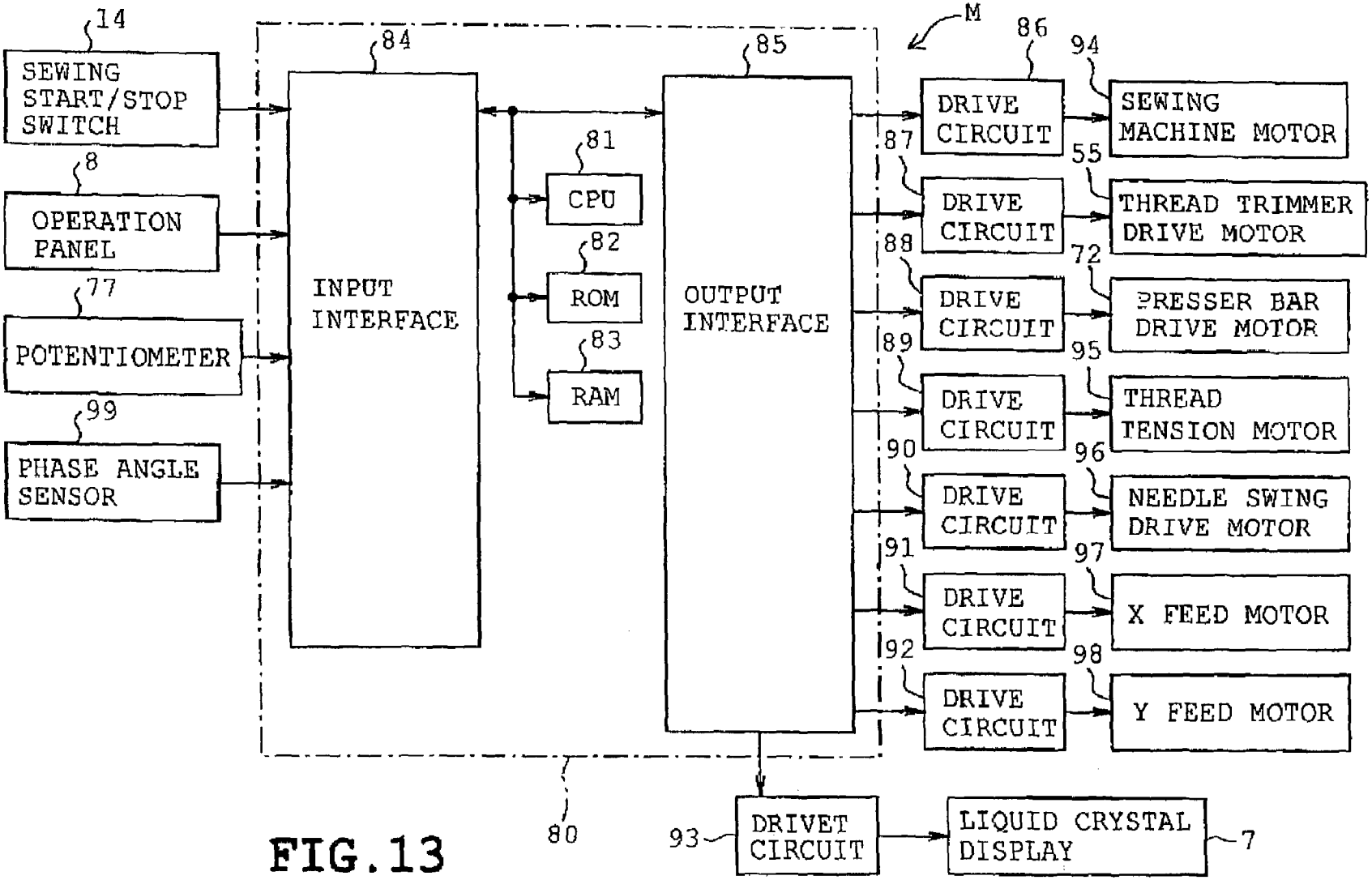
FIG. 13 shows a block diagram of control systems of the sewing machine.

Next, a control system of the sewing machine M is described with reference to FIG. 13. The control unit 80 of sewing machine M includes a microcomputer including a CPU 81, a ROM 82 and a RAM 83; an input interface 84, and an output interface 85 etc. In the input interface 84, a sewing start/stop switch 14, an operation panel 8, a potentiometer 77 and a phase angle sensor 99 etc. are electronically connected.

In the sewing machine main shaft (not shown), a circular encoding disk formed with a plurality of slits radially arranged in small predetermined angles are fixed. The phase angle sensor 99 is composed of a photo-interrupter, which outputs encoding signals for each reception of light which passes through the pluralities of micro slits in response to the rotation of the sewing machine main shaft. The control unit 80, by counting the pulse encoder signals, calculates the phase angle of the sewing machine main shaft. The phase angle of the sewing machine main shaft is assumed to be 0° when the needle bar 11 is in the highest position and when the phase angle is 0°, the count value is cleared.

In the aforementioned output interface 85, a drive circuit 86 for a sowing machine motor 94, a drive circuit 87 for a thread trimming motor 55, a drive circuit 88 for a presser bar drive motor 72, a drive circuit 89 for the thread tension motor 95 to drive the automatic thread tension mechanism and a drive circuit 90 for a needle swing drive motor 96 to drive the needle swinging mechanism are electronically connected. The output interface 85 is further electronically connected with a drive circuit 91 and 92 for an X feed motor 97 and a Y feed motor 98 provided in the embroidery frame drive mechanism 4 and a drive circuit 93 etc. for a liquid crystal display 7.

In the ROM 82, a utility pattern sewing data for a plurality of utility patterns such as zigzag stitches, a plurality types of embroidery data for embroidery sewing, drive control programs of various types to control the sewing machine M and a control program etc. for embroidery sewing control including the wiper drive are stored. In the RAM 83, various types of memories, pointers and counters etc. to store the calculated results of the calculation processed in the CPU 81 are provided on a required basis.

Figure 14:
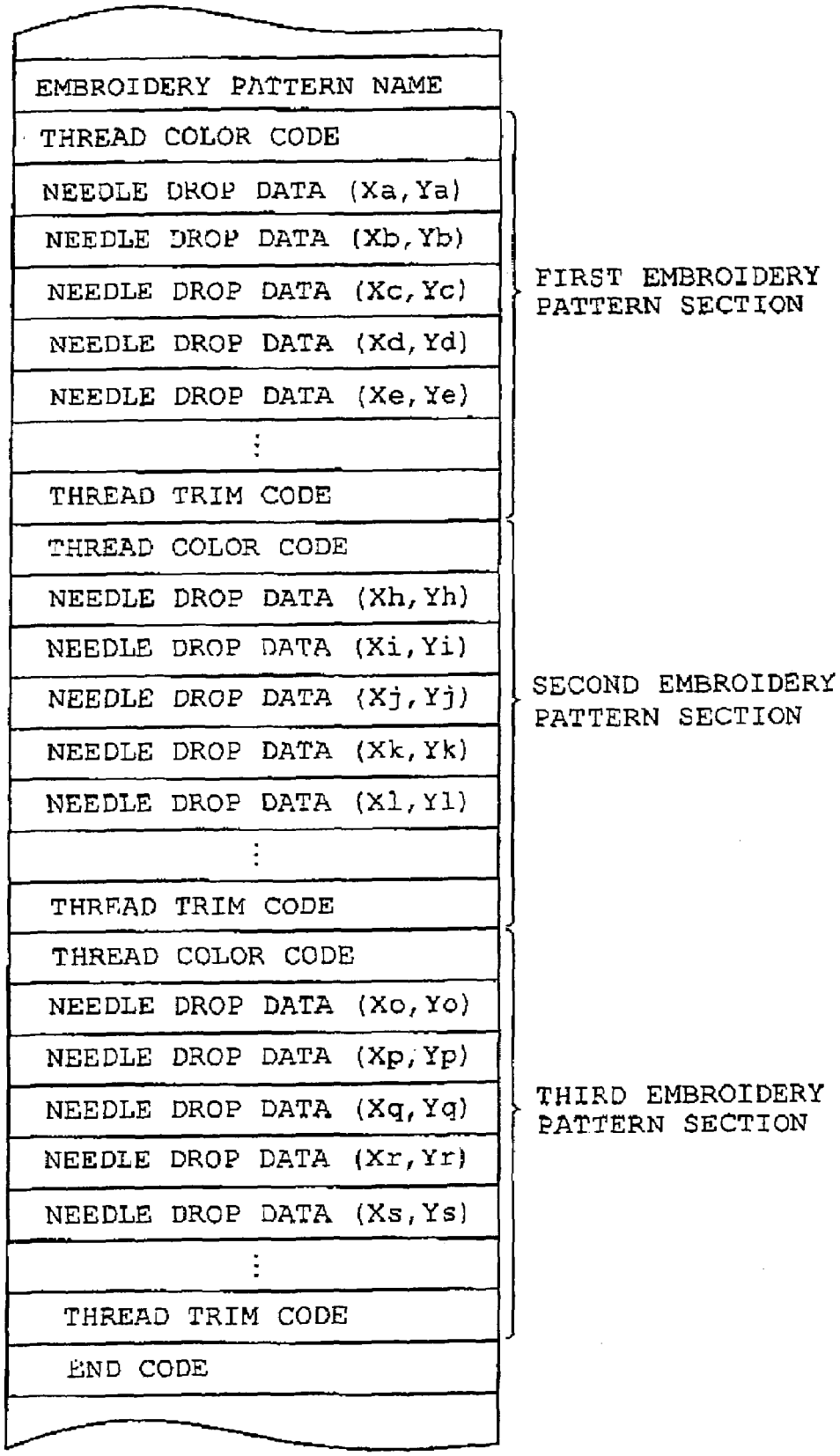
FIG. 14 describes a data configuration of embroidery data.

In the embroidery data as shown in FIG. 14, embroidery names, a plurality of needle drop data for embroidery pattern sections (for example, 3 embroidery pattern sections) and an "end code" to instruct the end of sewing are stored. Each embroidery pattern sections, for example, each first to third embroidery pattern section stores a "thread color code" at the beginning as well as storing a "thread trim code" at the end, in addition to the "needle drop data (x, y)" corresponding to each needle drop point.

Figure 15A:
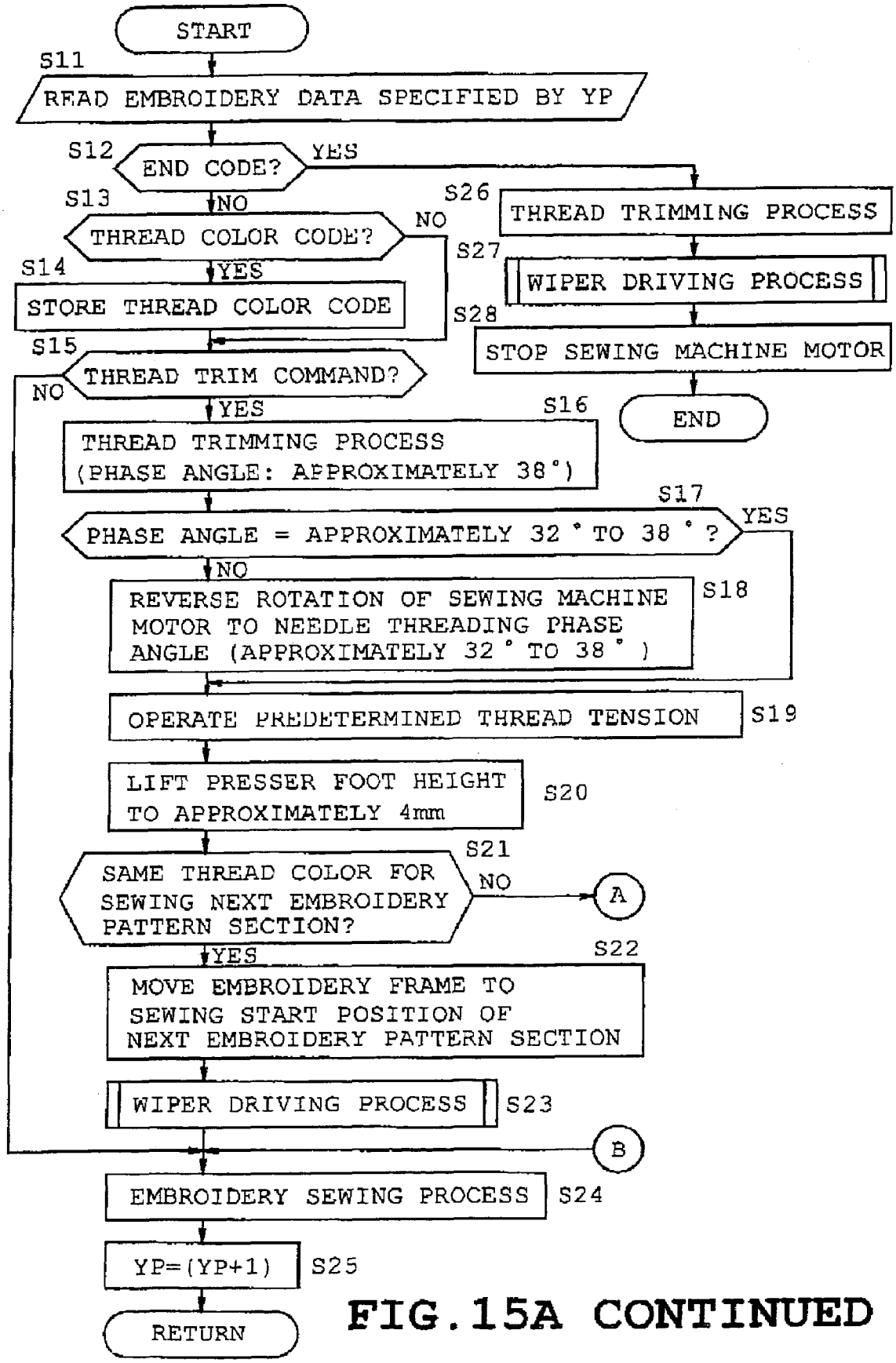
FIG. 15 is a flow chart of an embroidery sewing control including a wiper drive.
Figure 15B:
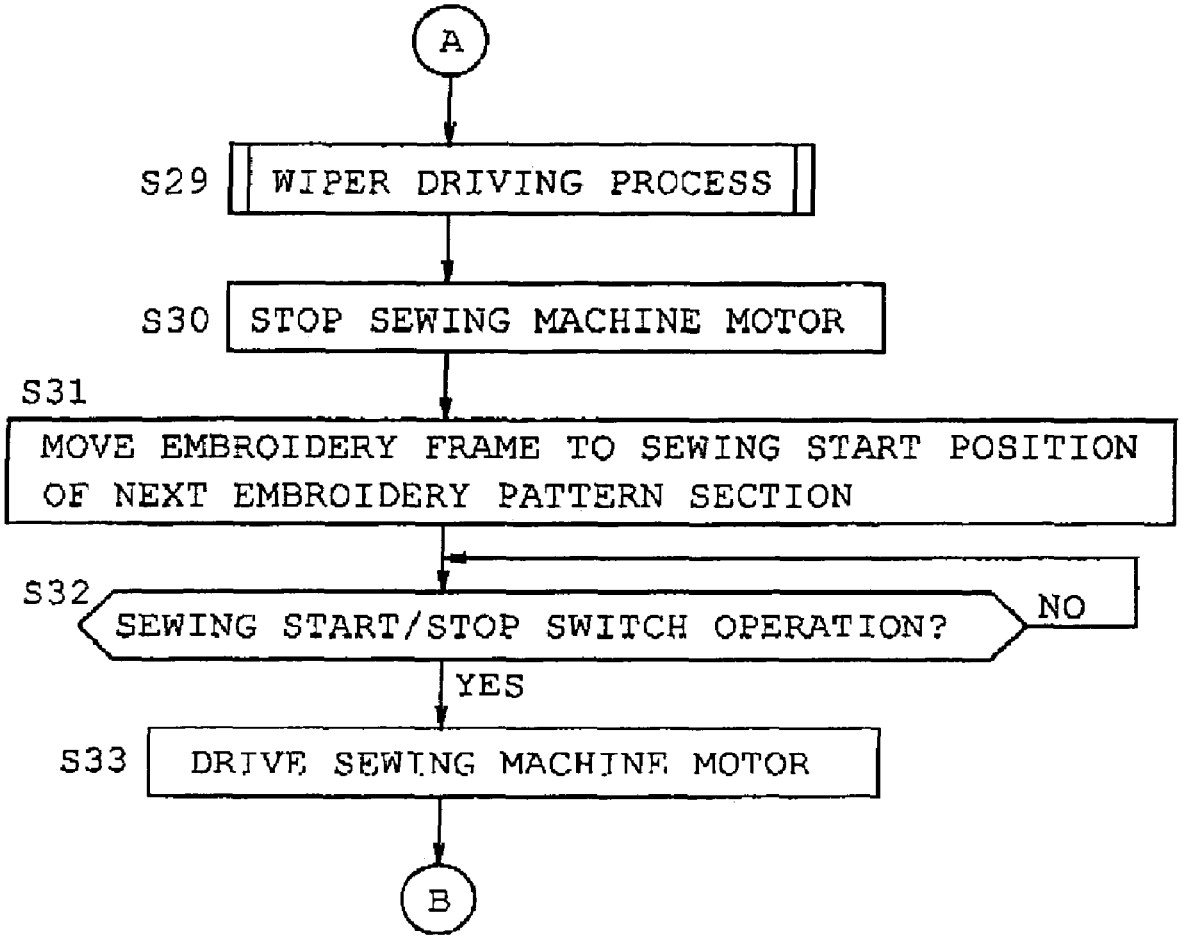

Next, the embroidery sewing control including the wiper drive executed by the control unit 80 is described based on the flow chart in FIG. 15. The Si (i=11, 12, 13 . . . ) in the figures indicate each step. The embroidery sewing control including the wiper drive is started by an interruption control for every single rotation of the sewing machine main shaft. Also, on sewing start, the initial address of the first embroidery pattern section is to be set for the reading pointer YP to read the embroidery data When sewing start is instructed by the operation of the sewing start/stop switch 14, the embroidery sewing control is started. First, among the pre-selected embroidery data of an embroidery pattern, the embroidery data specified by the reading pointer YP is road (S11). In case the embroidery data is the thread color code (S13: Yes) and not an end code (S12: No), the color code is stored (S14).

Also, in case the embroidery data read is not a thread trim code (S15: No), the embroidery sewing process is executed (S24) by moving the embroidery frame based on the needle drop data specified by the reading pointer YP. Then, after the reading pointer YP is incremented by 1 (S25), the control is terminated.

On the other hand, when embroidery sewing of one of the embroidery pattern section is ended and the embroidery data specified by the reading pointer YP is the thread trim code (S15; Yes), a thread trimming process to trim the upper and lower thread by the thread trimmer 6 is executed based on the thread trim code, when the phase angle of the sewing machine main shaft is 38° (S16). Subsequently, whether or not the phase angle is within the range of approximately 32° to 38° is determined (S17), and if the phase angle is not within the range (No), the sewing machine main shaft is rotated in the reverse direction (S18) so that the phase angle falls within the range of approximately 32° to 38° and to enable the needle threading by the automatic needle threading mechanism.

Next, a loose thread tension is operated on the upper thread (S19), which corresponds to a scale 4 of a thread tension dial, to prevent the upper thread from being supplied from the bobbin when the thread is trimmed. Concretely, by driving the thread tension motor 95, a pressured state is automatically set for a thread tension disc of the automatic thread tensioning mechanism provided on the bobbin side. Also, to enable the movement of the presser foot 32 without contacting the work cloth, the presser bar drive motor 72 is driven to lift the presser foot 32 4 mm above the needle plate 1*a* spring (S20).

After this, based on the embroidery data, the thread color code of the next embroidery pattern section is read and whether the color of the thread to be sewn after the thread trim is the same (the same color code) as the thread currently being sewn is determined (S21). Then, if the thread color code currently being sewn and the thread color code of the next embroidery section are the same (YES), after the embroidery frame is moved to the sewing start position of the next embroidery pattern section (S22), the wiper driving process is executed (S23).

Figure 16:
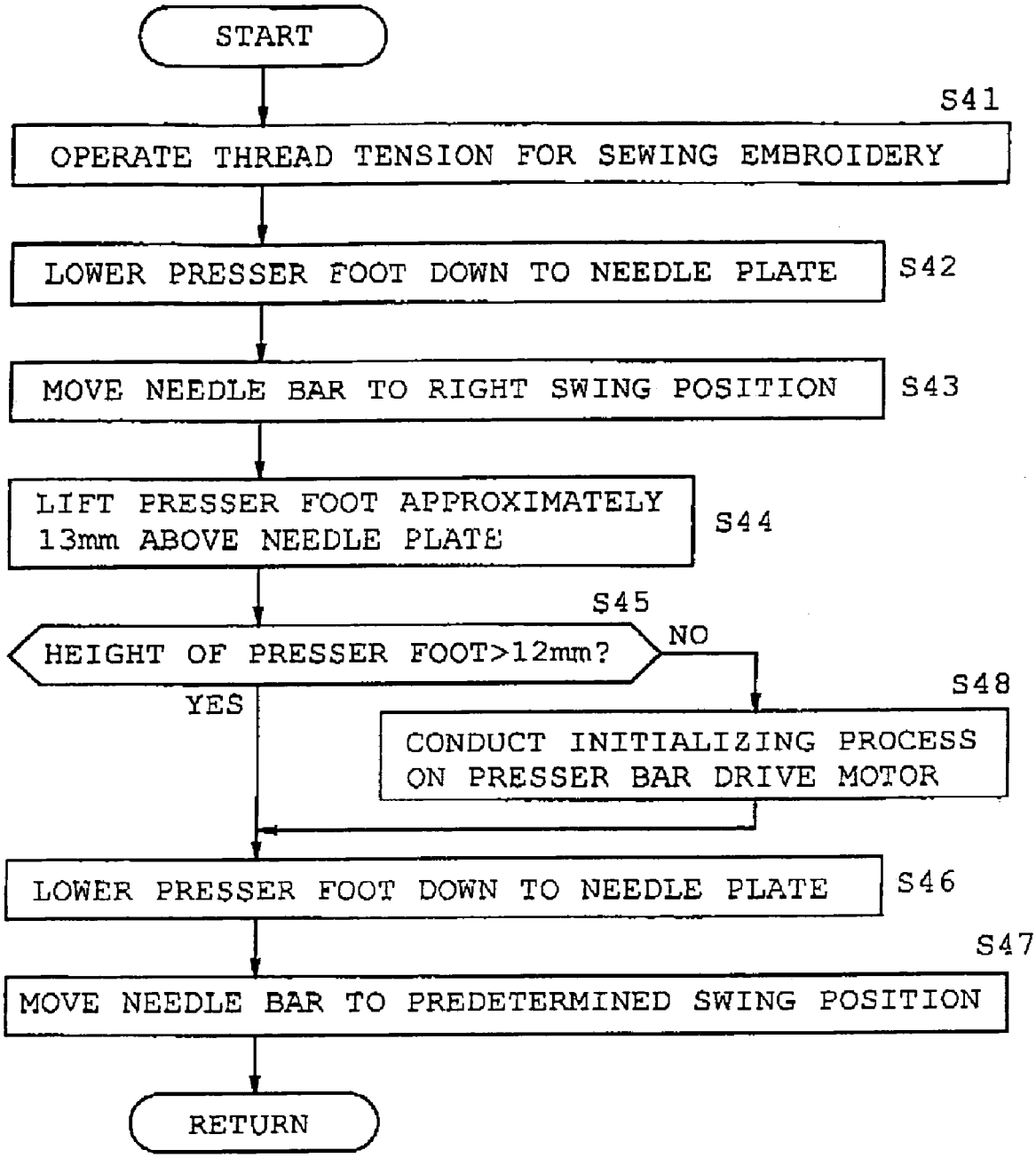
FIG. 16 is a flow chart of a wiper driving process control.

The wiper driving process is executed according to the flow chart shown in FIG. 16. That is, the thread tension motor 95 is driven, and a loose thread tension, for example, corresponding to scale 4 to 5 of the thread tension dial is operated (S41) on the upper thread as the thread tension of the embroidery sewing for the next embroidery pattern section.

Next, the presser bar drive motor 72 is driven to lower the presser foot 32 down to the needle plate 1*a* (down to the upper surface of the work cloth) (S42) as well as swinging the needle bar 11 to the right swing position (S43) by driving the needle swing drive motor 96. Subsequently, the presser foot 32 is lifted 13 mm above the needle plate 1*a* (S44) by driving The presser bar drive motor 72.

At this point, as described earlier, owning to the lifting of the presser bar 12 to the predetermined height, the contacting portion 35 contacts the needle bar support 44 in response to the lifting of the presser foot 32 along with the support member 24. Consequently, the wiper member 20 is actuated and an upper thread end 16 continuing from the eye of the sewing needle 10 to the work cloth via the presser foot 32 is wiped. (refer FIG. 8).

Next, whether the height of the presser foot 32 from the needle plate 1*a* calculated based on the resistance value of the potentiometer is equal or greater than approximately 12 mm is determined (S45). Then, if equal to or greater than approximately 12 mm (Yes), since the presser bar drive motor 72 is out-of-step, the presser foot 32 is lowered to the needle plate 1*a* (S46). Then, the needle bar 11 is moved to the predetermined position (S47) for the next needle drop by the drive of the needle swing drive motor 96. Finally, the wiper drive control is terminated and the control is returned to S24 of FIG. 15.

On the other hand, if the height of the presser foot 32 is lower than approximately 12 mm from the needle plate 1*a* (S45: NO), it is highly possible that the presser bar drive motor 72 is not out-of-step. Therefore, after executing an initializing process (S48) by pressing the presser foot 32 on the upper surface of the work cloth to drive the presser bar drive motor 72 to the predetermined rotation direction, the control proceeds to S46.

Also, if the color code of the next embroidery pattern section differs from the thread code currently being sewn (S21: No), the wiper driving process is executed (S29) as in S23 without moving the embroidery frame. After that, the drive of the sewing machine motor 94 is stopped (S30) and the embroidery sewing operation is interrupted to exchange the thread.

Then, the embroidery frame is moved to the sewing start position of the sewing pattern section (S31) and when the sewing start/stop switch 14 is operated (532: Yes) after completing the thread exchange, the sewing machine motor 94 is driven (S33) to restart the embroidery sewing process (S24).

On the other hand, in S12, if the embroidery data read is determined to be the end code (S12: Yes), after the thread trimming process as in S16 is executed (S26), a wiper driver process as in S23 is executed (S27). After this, the drive of the sewing machine motor 94 is stopped (S28) and the control is terminated.

Thus in the present embodiment example, whether the thread to be used after the thread trimming process is the same as the thread currently being sewn is determined based on the embroidery data. If the consistency of the thread is determined, after the execution of the thread trimming process by the thread trimming mechanism 6 and before the thread wiping operation by the thread wiping mechanism 15, the embroidery frame is moved by the embroidery frame driving mechanism 4 to the sewing start position of the embroidery pattern section to be sewn next, based on the embroidery data. Therefore, the upper thread end 16 continuing from the eye of the sewing needle 10 to penetrate the work cloth via the needle insertion 32*a* of the presser foot 32 can be reliably pulled out from the work cloth by the movement of the embroidery frame.

Moreover, the upper thread end 16 pulled out of the work cloth by the movement of the embroidery frame is dragged to the opposite direction of the movement of the embroidery frame while maintaining the inserted state to the needle insertion 32*a* of the presser foot 32. Then, after the embroidery frame moves to the sewing start position of the next embroidery pattern section, the upper thread end 16 is wiped by the thread wiping mechanism 15. Hence, the upper thread end 16 that slipped-in between the presser foot 32 and the work cloth can be pulled out and reliably prevent the upper thread end 16 from being sewn by subsequent sewing process.

Also, in case the thread to be used in the sewing process after the thread trim differs from the thread currently being sewn, the thread wiping mechanism 15 is driven immediately to perform the thread wipe. Therefore, the trimmed upper thread end 16 is reliably wiped when exchanging the thread by stopping the sewing operation.

Furthermore, when sewing based on the embroidery data is completed, the thread wipe mechanism 15 is driven immediately after the execution of the thread trim. Therefore, after trimming the thread due to sewing completion, the upper thread end 16 is reliably wiped.

Figure 17A:
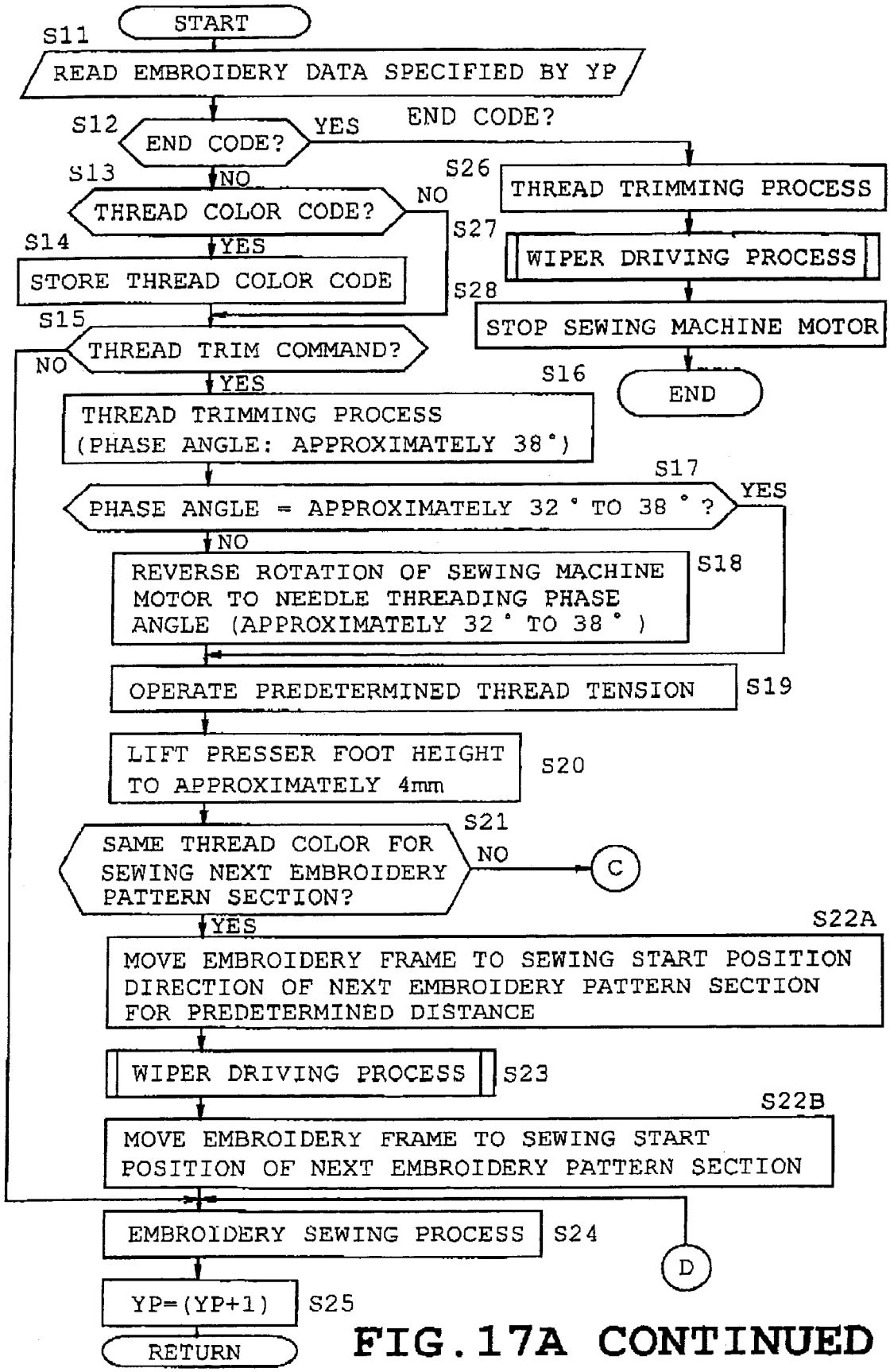
FIG. 17 corresponds to FIG. 15 describing a second embodiment example of the present disclosure.
Figure 17B:
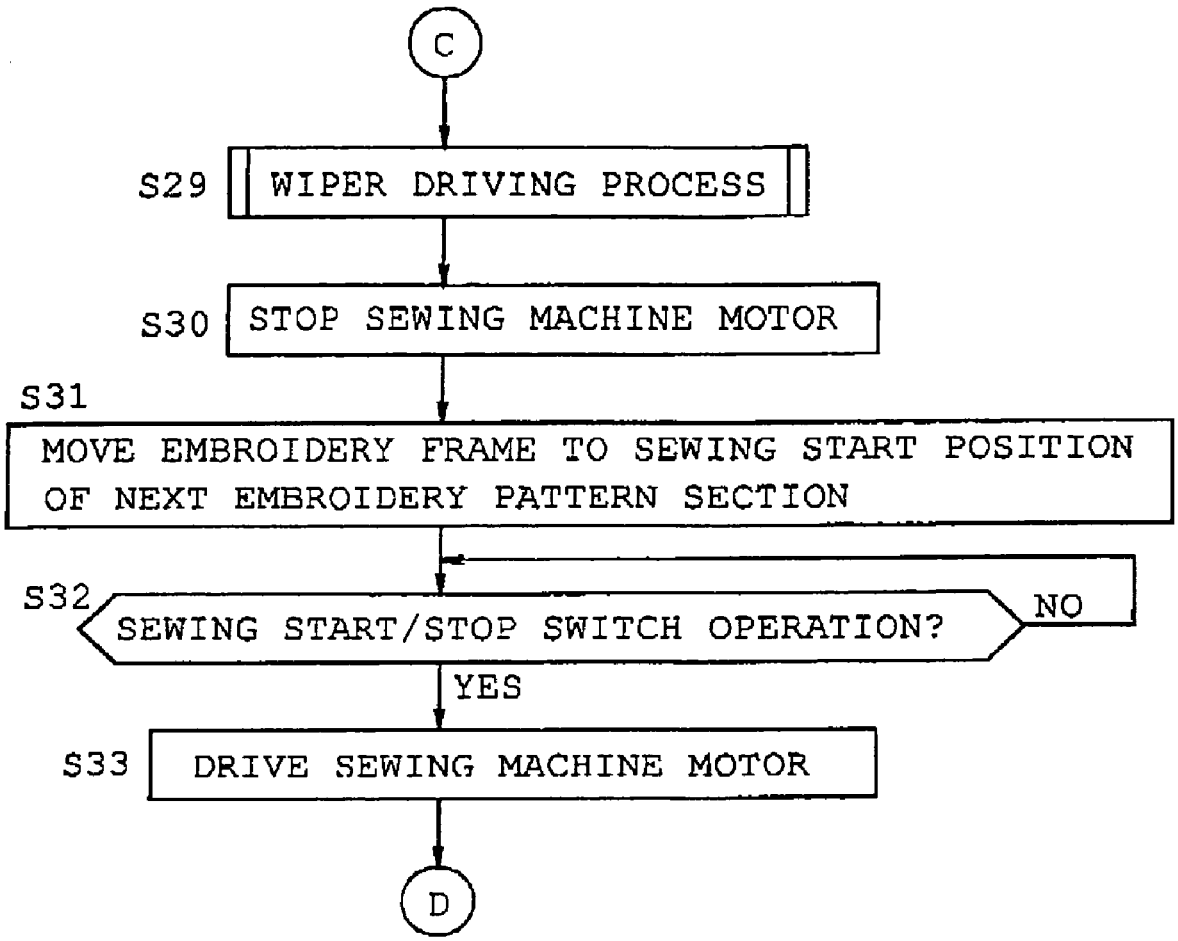

FIG. 17 shows a second embodiment of the present disclosure. The items that differ from the first embodiment are described hereinafter. In the second embodiment example, the movement to the sewing start position of the next embroidery pattern section is separated in 2 phases. That is, if the thread color code of the next embroidery pattern section is the same as the thread color code currently being sewn (S21), the embroidery frame is moved to the predetermined direction, for example, to the sewing start position of the next embroidery pattern section for only a predetermined distance (for example, approximately 5 mm) (S22A).

Next, the wiper driving process (refer to FIG. 16) is executed and the thread wipe by the thread wiping mechanism 15 is performed (S23). Consequently, the upper thread end 16 penetrating the work cloth from the eye of the sewing needle 10 and extending downward thereon is reliably pulled out over the work cloth. Then, the embroidery frame is moved to the sewing start position of the next embroidery pattern section (S22B).

Thus, after the execution of the thread trim by the thread trimming mechanism 6, by moving the embroidery frame to the predetermined direction for a predetermined distance, the upper thread end 16 extending from the eye of the sewing needle 10 through the needle insertion 32*a* of the presser foot 32 and on to the back of the work cloth can be reliably pulled out from the work cloth.

The present disclosure is not to be limited to the above embodiment example and can be transformed as follows.

In the second embodiment example, the direction to move the embroidery frame can be any position, irrelevant to The sewing start position of the embroidery pattern section. In such case also, the upper thread end 16 extending from the eye of the sewing needle 10 through the needle insertion 32*a* of the presser foot 32 and on to the back of the work cloth can be reliably pulled out from the work cloth.

In the embroidery data used in the above embodiment example, the thread trim code is pre-stored; however, some embroidery data do not include the thread trim code. In such case, the thread trim code can be added and stored immediately before the stitch, in which the stitch length provided as feed data is longer than the predetermined distance.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine capable of embroidering comprising:

a sewing mechanism having a sewing needle;

a frame moving mechanism that moves an embroidery frame based on embroidery data composed of a plurality of embroidery pattern sections;

a thread trimming mechanism that executes a thread trim operation based on a thread trim instruction;

a thread wiping mechanism that executes a thread wiping operation after the execution of the thread trim operation by the thread trimming mechanism; and a controlling unit that moves the embroidery frame by the frame moving mechanism to a sewing start position of the next embroidery pattern section based on the embroidery data after the thread trim operation by the thread trimming mechanism and before the execution by the thread wiping operation of the thread wiping mechanism.

2. The sewing machine capable of embroidering according to claim 1, wherein the control unit, when completing a sewing operation based on the embroidery data, immediately executes the thread wiping operation by the thread wiping mechanism after the execution of the thread trim operation by the thread trimming mechanism.

3. A sewing machine capable of embroidering comprising:

a sewing mechanism having a sewing needle;

a frame moving mechanism that moves an embroidery frame based on embroidery data composed of a plurality of embroidery pattern sections;

a thread trimming mechanism that executes a thread trim operation based on a thread trim instruction;

a thread wiping mechanism that executes a thread wiping operation after the execution of the thread trim operation by the thread trimming mechanism;

a determining unit that determines whether a color of a thread to be used in a sewing process after the execution of thread trim operation is same as a color used in the a thread currently being sewn; and a controlling unit that moves the embroidery frame by the frame moving mechanism to a sewing start position of the next embroidery pattern section based on the embroidery data after the thread trim operation of the thread trimming mechanism and before the execution of the thread wiping operation of the thread wiping mechanism, if a thread color is determined to be the same by the determining unit, wherein if the thread color is determined to be different by the determining unit, immediately performs the thread wiping operation by the thread wiping mechanism after executing the thread trim operation by the thread trimming mechanism.

4. The sewing machine capable of embroidering according to claim 3, wherein the control unit, when completing the sewing operation based on the embroidery data, immediately executes the thread wiping operation by the thread wiping mechanism after the execution of the thread trim operation by the thread trimming mechanism.

5. A sewing machine capable of embroidering comprising:

a sewing mechanism having a sewing needle;

a frame moving mechanism that moves an embroidery frame based on embroidery data composed of a plurality of embroidery pattern sections;

a thread trimming mechanism that executes a thread trim operation based on a thread trim instruction;

a thread wiping mechanism that executes a thread wiping operation after the execution of the thread trim operation by the thread trimming mechanism; and a controlling unit that moves the embroidery frame by the frame moving mechanism in a predetermined direction for a predetermined distance after the thread trim operation by the thread trimming mechanism and before the execution by the thread wiping operation of the thread wiping mechanism.

6. A program stored in a computer-readable media of a sewing machine capable of embroidering provided with a sewing mechanism having a sewing needle, a frame moving mechanism to move an embroidery frame, a thread trimming mechanism to execute a thread trim operation and a thread wiping mechanism to execute a thread wiping operation, the program comprising:

a routine to execute the thread trim operation by the thread trimming mechanism;

a routine to move the embroidery frame by the frame moving mechanism to a sewing start position of the next embroidery pattern composed of plurality of embroidery pattern sections based on embroidery data after the thread trim operation by the thread trimming mechanism; and a routine to execute the thread wiping operation by the thread wiping mechanism after moving the embroidery frame to the sewing start position.

7. A program stored in a computer-readable medium of a sewing machine capable of embroidering provided with a sewing mechanism having a sewing needle, a frame moving mechanism to move an embroidery frame, a thread trimming mechanism to execute a thread trim operation and a thread wiping mechanism to execute a thread wiping operation, the program comprising:

a routine to execute the thread trim operation by the thread trimming mechanism;

a routine to move the embroidery frame by the frame moving mechanism in a predetermined direction for a predetermined distance; and a routine to execute the thread wiping operation by the thread wiping mechanism after moving the embroidery frame.

8. The program of claim 7, wherein the routine to move the embroidery frame by the frame moving mechanism in the predetermined direction for the predetermined distance is executed after the thread trim operation by the thread trimming mechanism.

* * * * *